US007773917B2

(12) United States Patent
Makino

(10) Patent No.: US 7,773,917 B2
(45) Date of Patent: Aug. 10, 2010

(54) TONER CONVEYING APPARATUS FOR SUPPLYING TONER TO A DEVELOPING APPARATUS

(75) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 12/031,390

(22) Filed: Feb. 14, 2008

(65) Prior Publication Data

US 2008/0199225 A1 Aug. 21, 2008

(30) Foreign Application Priority Data

Feb. 21, 2007 (JP) ..... 2007-040159

(51) Int. Cl.
*G03G 15/08* (2006.01)

(52) U.S. Cl. ..... 399/258; 399/256; 399/263

(58) Field of Classification Search ..... 399/254–256, 399/258–260, 262
See application file for complete search history.

(56) References Cited

U.S. PATENT DOCUMENTS 7,110,707 B2 9/2006 Nishitani
7,139,516 B2 11/2006 Makino

FOREIGN PATENT DOCUMENTS

| | | | |
|---|---|---|---|
| JP | 3-217879 | A | 9/1991 |
| JP | 2000-39774 | A | 2/2000 |
| JP | 2004-347794 | A | 12/2004 |

OTHER PUBLICATIONS

Japanese Office Action dated Dec. 9, 2008 in Japanese Application No. 2007-040159, and an English-language translation thereof.
English-language machine translation of JP2004-347794.

*Primary Examiner*—Hoang Ngo
(74) *Attorney, Agent, or Firm*—Fitzpatrick, Cella, Harper & Scinto

(57) ABSTRACT

A toner conveying apparatus comprising: a toner conveying member which discharges toner outside a toner accommodating portion; toner conveying passage which receives toner discharged from the toner accommodating portion; and a screw constituted such that a pitch in its region downstream in the toner conveying direction is wider than a pitch in its region upstream in the toner conveying direction; and a drive device which drives the toner conveying member and the screw; wherein if a toner feeding amount per unit drive time of the toner conveying member is defines as V1, and a toner feeding amount per unit drive time in the region of the screw upstream in the toner conveying direction is defined as V2, and a toner feeding amount per unit drive time in the region of the screw downstream in the toner conveying direction is defined as V3, a relation equation of V2≦V1<V3 is satisfied.

7 Claims, 12 Drawing Sheets

SHUTTER IS CLOSED

SHUTTER IS OPENED

TONER CONVEYING APPARATUS FOR SUPPLYING TONER TO A DEVELOPING APPARATUS

BACKGROUND OF THE INVENTION

1. Field of the Invention

The present invention relates to a toner conveying apparatus, and more particularly, to a toner conveying apparatus which supplies toner to a developing apparatus which develops an electrostatic image formed on an image bearing member in an image forming apparatus using toner.

2. Description of the Related Art

In a conventional image forming apparatus, if an electrostatic image on an image bearing member is developed and an amount of toner in a developing apparatus becomes less than a defined amount, toner is supplied into the developing apparatus from a toner supply apparatus (hopper, hereinafter) which stores toner. An apparatus which uses one component developer and an apparatus which uses two component developer supply the toner in the same manner.

A hopper normally includes a toner cartridge which supplies new toner, and a buffer portion which accommodates toner supplied from the toner cartridge (see Japanese Patent Application Laid-open No. 3-217879 for example). If the amount of toner in the buffer portion of the hopper is reduced, a toner sensor provided in the buffer portion detects the shortage of toner, toner is supplied from the toner cartridge, and the toner amount in the buffer portion is always maintained at a constant level.

A conventional hopper has a long shape as shown in FIG. 1 in many cases. In a hopper 200 of this type, toner supplied from a toner cartridge 201 drops into a buffer portion 202 by gravity and stays therein, and the toner is supplied to a developing apparatus 204 by a screw 203 provided on a bottom of the buffer portion 202. In the case of a system replenishing the buffer portion 202 with toner by gravity, bulk density of toner in the buffer portion 202 is prone to be varied while the toner stays in the buffer portion 202 and the amount of toner to be fed to the developing apparatus 204 is prone to be varied.

As one means for reducing the variation in bulk density of toner in the hopper, there is a system for circulating toner in a shallow buffer portion as shown in FIG. 12. According to the hopper of this system, toner supplied into the buffer portion 211 from the toner cartridge is circulated and conveyed into the buffer portion 211 by stirring screws 212*a* and 212*b* and the toner is equalized. Toner conveyed to an opening 213 by a first conveying screw 212*c* in the buffer portion 211 is conveyed to a developing apparatus by a second conveying screw in a toner conveying section (not shown). With this, as compared with a system which replenishes the buffer portion with toner by gravity, it is possible to suppress the bulk density variation in the buffer portion.

Further, in order to further stabilize the bulk density, there is a method in which toner is crammed into the toner conveying section provided with the second conveying screw, thereby eliminating gaps in the toner conveying section, and variation in the amount of toner to be fed to the developing apparatus is reduced. More specifically, a relation between toner feeding amounts by the two conveying screws is established such that a toner feeding amount of the first conveying screw is equal to or greater than a toner feeding amount of second conveying screw, so as to prevent gaps from being formed in the toner conveying section during conveying of toner by the second conveying screw.

According to the structure of the conventional hopper, however, as the length of the second conveying screw in the toner conveying direction becomes longer, greater rotation torque for sending the toner crammed into the toner conveying section is required, and a pressure applied to the toner itself is increased. If temperature influences of the image forming apparatus and environment are added thereto, the toner concentration degree is increased, toner adheres to blades of the second conveying screw, toner is not fed in the conveying direction and toner rotates together with the blades and the toner is not conveyed. If such a phenomenon occurs, if the relation that the toner feeding amount of the first conveying screw is equal to or greater than the toner feeding amount of the second conveying screw is established, toner which is not conveyed is further crammed into a certain portion, the pressure partially applied to toner is further increased. With this, a vicious circle that the toner concentration degree is increased and toner adheres to the blades of the conveying screw and the pressure applied to the toner is further increased is repeated. As a result, the rotation of the conveying screw is locked, supply failure of toner occurs, toner clump is generated and there is an adverse possibility that image failure occurs.

SUMMARY OF THE INVENTION

Hence, the present invention provides a toner conveying apparatus capable of preventing a concentration degree of toner from increasing while stabilizing the bulk density of toner and capable of stably conveying toner.

To achieve the above object, a toner conveying apparatus comprises: a toner accommodating portion which accommodates toner therein; a toner conveying member which is provided in the toner accommodating portion and which discharges toner outside the toner accommodating portion; toner conveying passage which receives toner discharged from the toner accommodating portion; and a screw which is provided in the toner conveying passage and which conveys the toner in the toner conveying passage toward the developing apparatus, in which the screw is constituted such that a pitch in its region downstream in the toner conveying direction is wider than a pitch in its region upstream in the toner conveying direction; and a drive device which drives the toner conveying member and the screw; wherein if a toner feeding amount per unit drive time of the toner conveying member is defined as V1, and a toner feeding amount per unit drive time in the region of the screw upstream in the toner conveying direction is defined as V2, and a toner feeding amount per unit drive time in the region of the screw downstream in the toner conveying direction is defined as V3, the following relation equation is satisfied: $V2 \leqq V1 < V3$.

To achieve the above object, a toner conveying apparatus of another embodiment comprises: a toner accommodating portion which accommodates toner therein; a first screw which is provided in the toner accommodating portion and which discharges toner outside the toner accommodating portion; toner conveying passage which receives toner discharged from the toner accommodating portion; and a second screw which is provided in the toner conveying passage and which conveys the toner in the toner conveying passage toward the developing apparatus, in which the second screw is constituted such that a pitch in a region thereof downstream in the toner conveying direction is wider than a pitch in a region thereof upstream in the toner conveying direction; and a drive device which drives the first screw and the second screw; wherein if the number of revolutions of the first screw when the second screw is rotated by one turn by the drive device is defined as n, and a toner feeding amount of the first screw per one pitch is defined as V1, and a toner feeding amount of the second screw per one pitch in the region of the second screw upstream in the toner conveying direction is defined as V2, and a toner feeding amount of the second screw per one pitch in the region of the second screw downstream in the toner conveying direction is defined as V3, the following relation equation is satisfied: $V2 \leqq V1 \times n < V3$.

Further features of the present invention will become apparent from the following description of exemplary embodiments with reference to the attached drawings.

DESCRIPTION OF THE EMBODIMENTS

A preferred exemplary embodiment of the present invention will be described in detail with reference to the drawings. Sizes, materials, shapes and relative dispositions of constituent parts described in the embodiment should appropriately be changed in accordance with a structure and various conditions of the apparatus to which the invention is applied. Therefore, the scope of the invention is not limited to the sizes, the materials, the shapes and the relative dispositions unless otherwise specified.

Figure 1:
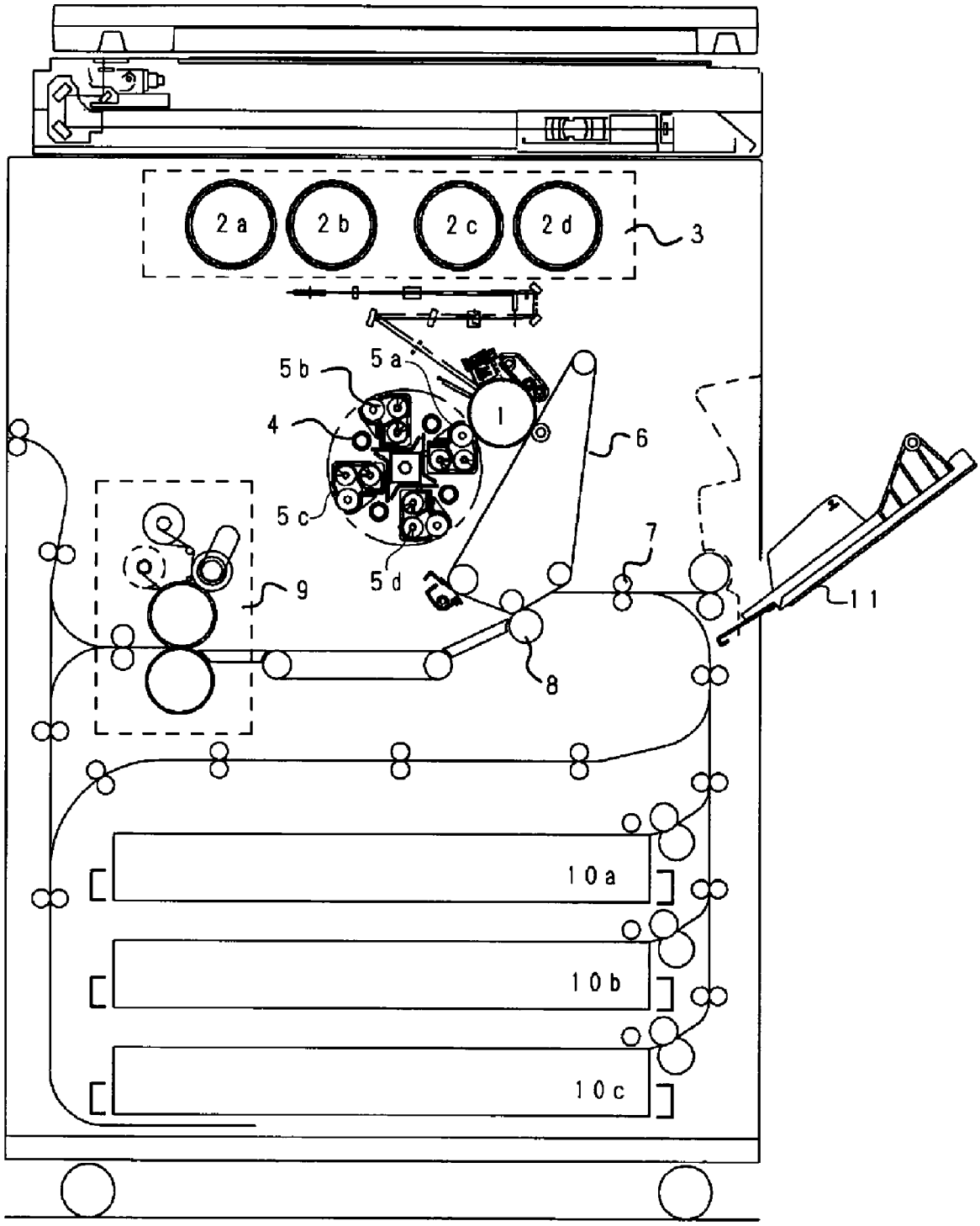
FIG. 1 is a main sectional view of an image forming apparatus.

An outline of an image forming apparatus will be described using FIG. 1. Image information which is read by a reader portion is converted into a light signal (laser light) on a color-to-color basis by a laser output portion, and is reflected by a polygon mirror, and the light signal is exposed to light by a surface photoconductive drum 1 through a lens and a folded mirror.

A charger, developing devices (5*a*, 5*b*, 5*c*, 5*d*) constituted in a developing rotary 4, and a cleaning device are disposed around the photoconductive drum 1 as an image bearing member. The exposed electrostatic image on the photoconductive drum 1 is developed with various colors by rotating the developing rotary 4 and repeating the switching step of the developing apparatus by the number of necessary colors. Toner image of each color on the photoconductive drum 1 is transferred onto the intermediate transfer belt 6 each time, and after images of necessary colors are superposed on the intermediate transfer belt 6, it is conveyed to the transfer portion 8 for a sheet (transfer material).

Sheets are selectively fed by cassettes 10*a*, 10*b*, 10*c* or a multi-manual tray 11, skew feeding is corrected and timing is adjusted by a registration roller 7 and the sheets are conveyed to the image transfer portion 8.

If a sheet passed through the image transfer portion 8, toner is thermally fixed by a fixing portion 9, and the sheet is sent to a discharge step or a duplex image forming step.

Here, toner in the developing apparatuses 5*a*, 5*b*, 5*c*, 5*d* is supplied by a necessary amount by toner cartridges 2*a*, 2*b*, 2*c*, 2*d* which is detachably accommodated in the toner supply apparatus (toner conveying apparatus) 3. The toner is supplied from one of the toner cartridges 2 corresponding to one of the developing apparatuses 5 which is rotated to the developing position (position opposed to the photoconductive drum) by the developing rotary 4.

Figure 4:
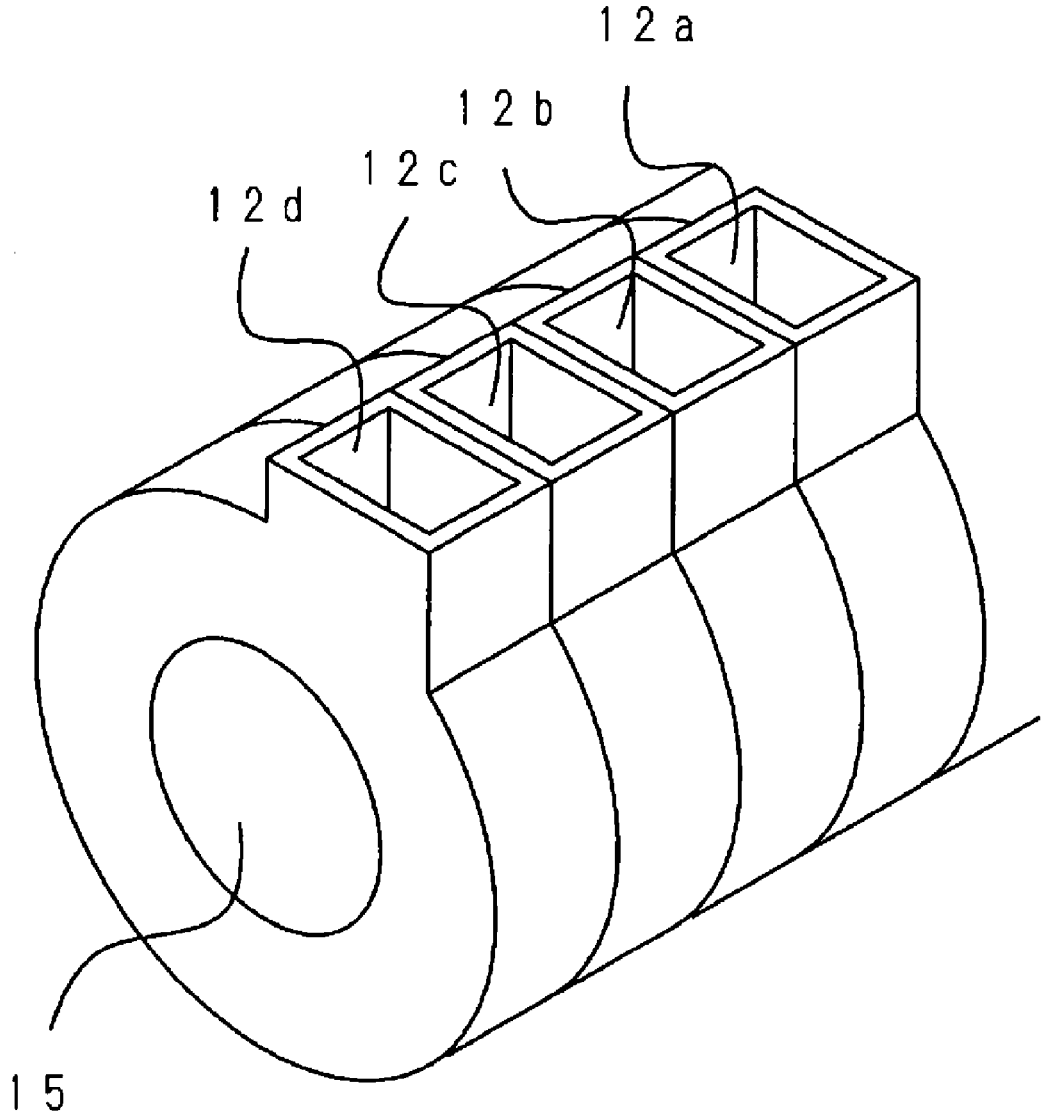
FIG. 4 is a perspective view of a toner supply portion in the toner supply apparatus.

In the case of the rotary developing structure, since toner is received at one specific position (here, developing position), toner is delivered to the developing apparatus and developing rotary through a toner supply portion 15 shown in FIG. 4. The toner supply portion 15 is divided into the number of colors on the frontward side of the developing rotary and in the frontward direction and rearward direction and fixed.

Figure 2:
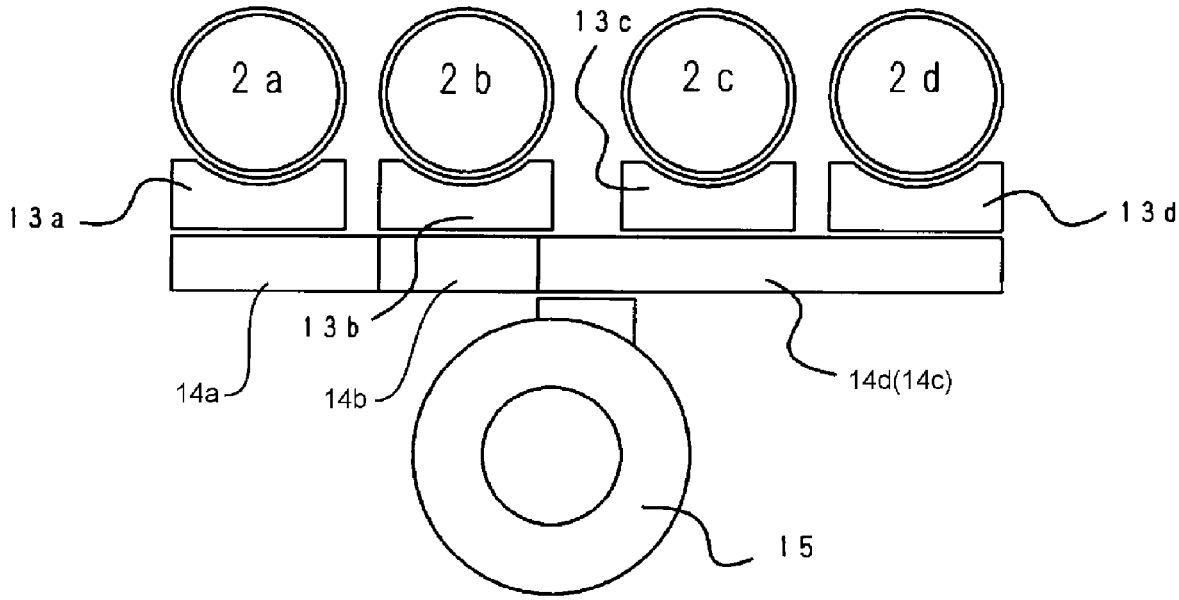
FIG. 2 is a front view of a toner supply apparatus.
Figure 3:
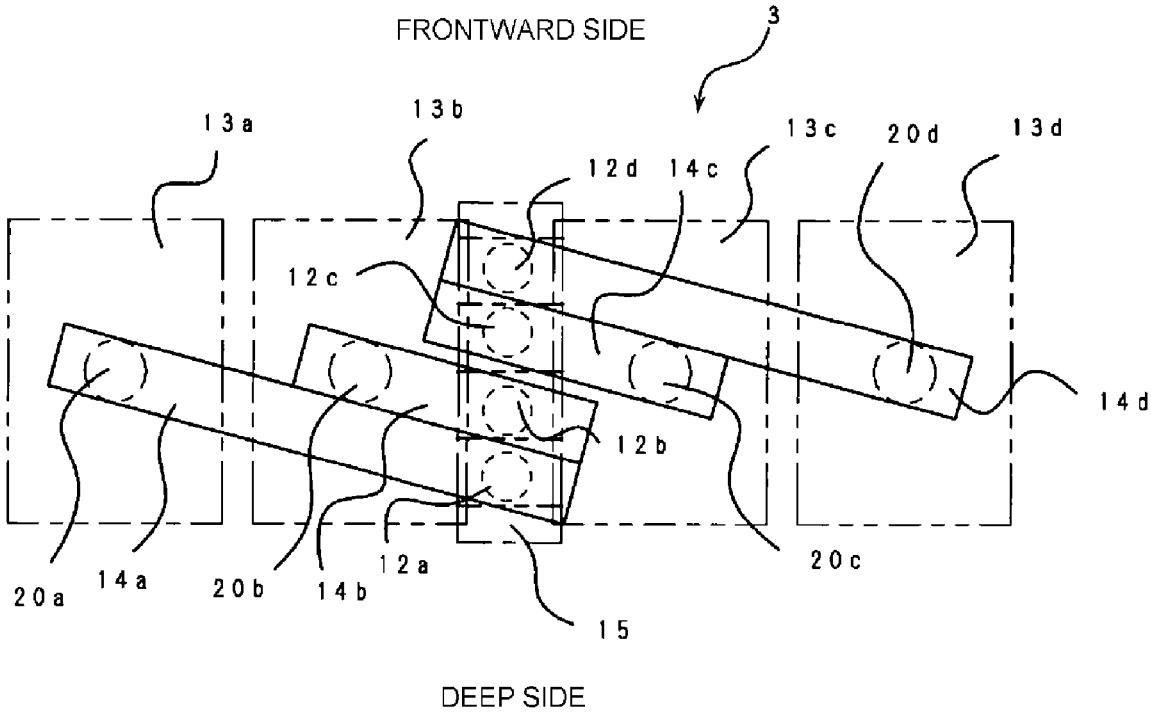
FIG. 3 is a bottom view of the toner supply apparatus.

Next, outline of toner supply from the toner cartridge 2 to the toner supply portion 15 will be described using FIGS. 2 and 3. FIG. 2 is a front view of the toner supply apparatus 3, and FIG. 3 is a bottom view of the toner supply apparatus 3.

The toner supply apparatus 3 is provided above the toner supply portion 15 and on the frontward side of the image forming apparatus. The toner supply apparatus 3 includes toner cartridge 2 (2*a*, 2*b*, 2*c*, 2*d*), toner supply portions 13 (13*a*, 13*b*, 13*c*, 13*d*) and supply pipes 14 (14*a*, 14*b*, 14*c*, 14*d*).

If the toner sensor 16 of the toner supply portion 13 detects shortage of toner, toner in the toner cartridge 2 is conveyed to the toner supply portion 13 from the cartridge discharge opening 37 (see FIG. 7) below the toner cartridge 2. The toner is conveyed from the toner cartridge 2 to the toner supply portion 13 until the toner sensor 16 (see FIG. 5) detects toner after the toner sensor 16 of the toner supply portion 13 detects the shortage of toner.

The toner supply portions (13*a* to 13*d*) accumulate a certain amount of toner, and when the toner supply portions receive a toner supply signal from the image forming apparatus, the toner supply portions discharge toner to the supply pipe 14 from the discharge opening 20 in the toner supply portion 13 by a predetermined amount while the developing rotary 4 stops at the developing position.

As described later, the screw of the supply pipe 14 is driven by the same drive apparatus as that of the screw of the toner supply portion 13, the screw of the supply pipe 14 receives toner from the toner supply portion 13 and discharges the toner to the toner supply portion 15.

The toner supply portion 15 is provided on the frontward side of the developing rotary 4. As shown in FIG. 4, the toner supply portion 15 includes four supply openings 12*a*, 12*b*, 12*c*, 12*d* defined in the rearside direction and the frontward direction. Each supply opening is in communication with a developing apparatus 5 provided in the developing rotary 4.

The supply openings 12 are disposed such that the yellow supply opening 12*a*, the magenta supply opening 12*b*, a cyan supply opening 12*c* and the black supply opening 12*d* in this order from the rearside of the image forming apparatus.

The developing apparatus 5 is a rotating developing system. Therefore, the developing apparatus 5 can receive toner at one specific position (here, developing position opposed to the photoconductive drum). Therefore, the supplying operations are sequentially repeated by rotating the developing rotary 4 for each of the colors.

Figure 5:
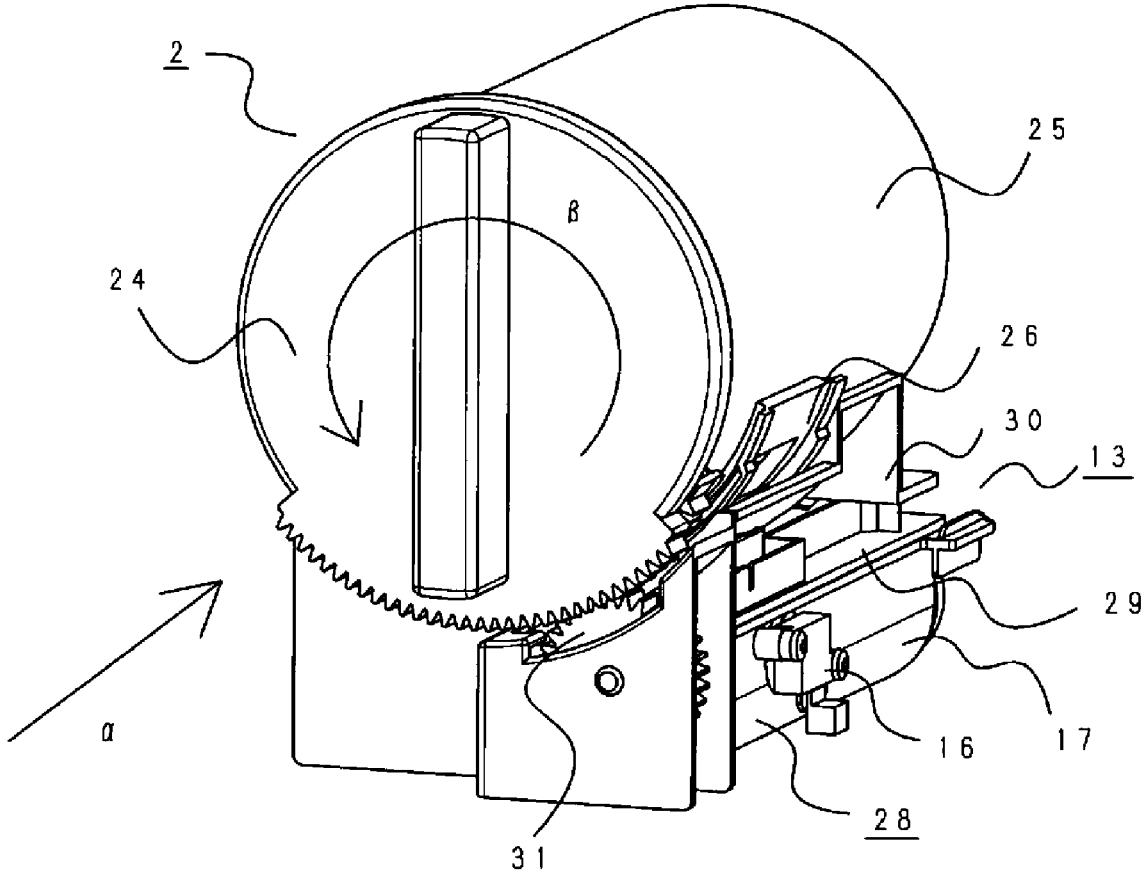
FIG. 5 is a perspective view of the toner supply apparatus.
Figure 6:
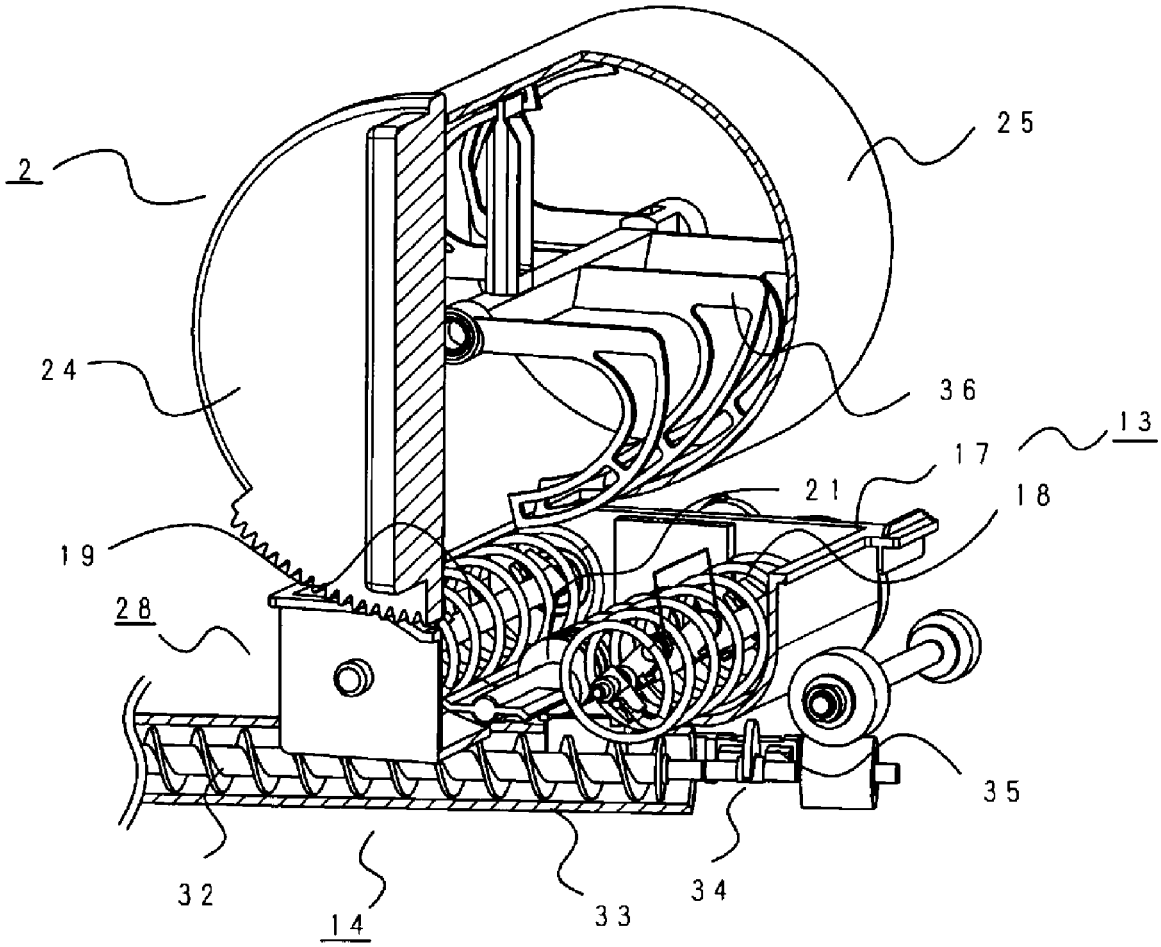
FIG. 6 is a sectional view of the toner supply apparatus.

Next, detailed structures of the toner cartridge 2 and the toner supply portion 13 will be described using FIGS. 5 and 6. FIG. 5 is a perspective view showing one of the colors of the toner supply apparatus 3. FIG. 6 is a sectional view thereof.

The toner cartridge 2 and the toner supply portion 13 of the toner supply apparatus 3 for each color are constituted in the same manner.

The toner cartridge 2 includes a toner container 25 accumulating toner, and a handle 24 for opening and closing a later-described buffer shutter 26. The toner cartridge 2 includes a cartridge shutter 27 (see FIG. 7) for closing the cartridge discharge opening 37 (see FIG. 7) formed in a toner container 25. The toner cartridge 2 further includes stirring blades 36 for stirring the toner in the toner cartridge 2 and discharges the toner from the cartridge discharge opening 37.

The toner supply portion 13 includes a support stage 30 for supporting the toner cartridge 2, a buffer portion 28 for accumulating the toner, and a buffer cover 29 for closing an upper surface of the buffer portion 28. The buffer portion 28 is a toner accommodating portion for accommodating the toner, and includes a buffer container 17 for accumulating toner. The buffer portion 28 is provided with stirring screws 18 and 19 for stirring the toner in the buffer portion 28 and circulating and conveying the toner, and a conveying screw (toner conveying member) 21 as first toner conveying unit for conveying toner in the buffer portion 28 to the supply pipe 14. The buffer portion 28 is also provided with the toner sensor 16 for detecting whether there is toner in the buffer portion 28.

The supply pipe 14 is a toner conveying portion for conveying toner discharged from the buffer portion 28 to the developing apparatus 5 through the toner supply portion 15. The supply pipe 14 is provided with a supply screw 32 as second toner conveying unit for conveying toner discharged from the buffer portion 28 to the toner supply portion 15. The supply pipe 14 is also provided with a pipe portion (toner conveying passage) 33 for covering the supply screw 32. The supply pipe 14 is further provided with a detector for detecting the number of revolutions of the supply screw 32. Here, there are provided a flag 34 and a photo-interrupter 35 for counting the number of revolutions of the supply screw 32 as the detector.

The supply screw 32 can convey toner of one pitch by one rotation by the flag 34 and the photo-interrupter 35. In the case of a general screw, the feeding amount of toner pulses and repeats increase and decrease even during one rotation due to influence of a positional relation of the blades with respect to the opening. Therefore, the screw always rotates one rotation by one rotation and the position of the blade of the screw with respect to the opening is the same so that influence of pulsation is not easily received.

Figure 7A:
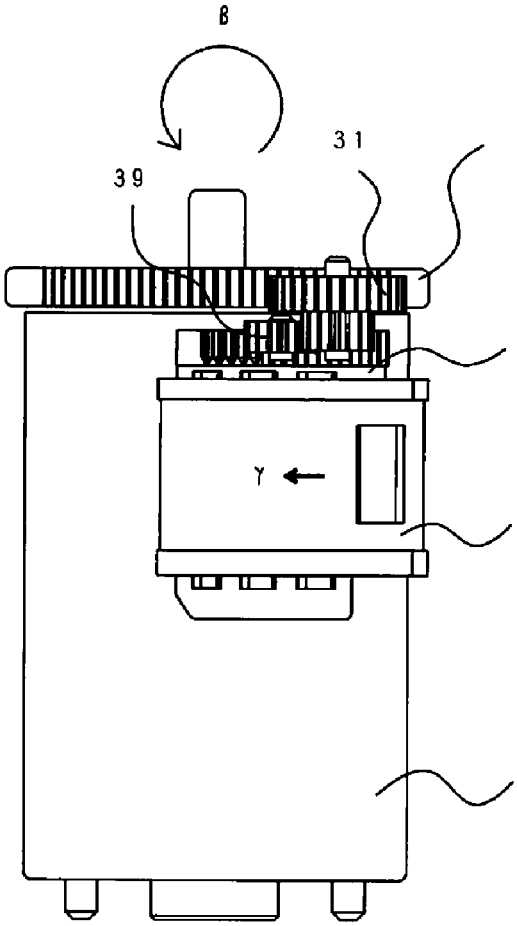
FIGS. 7A and 7B are diagrams illustrating operation of a cartridge shutter in the toner supply apparatus.
Figure 7B:
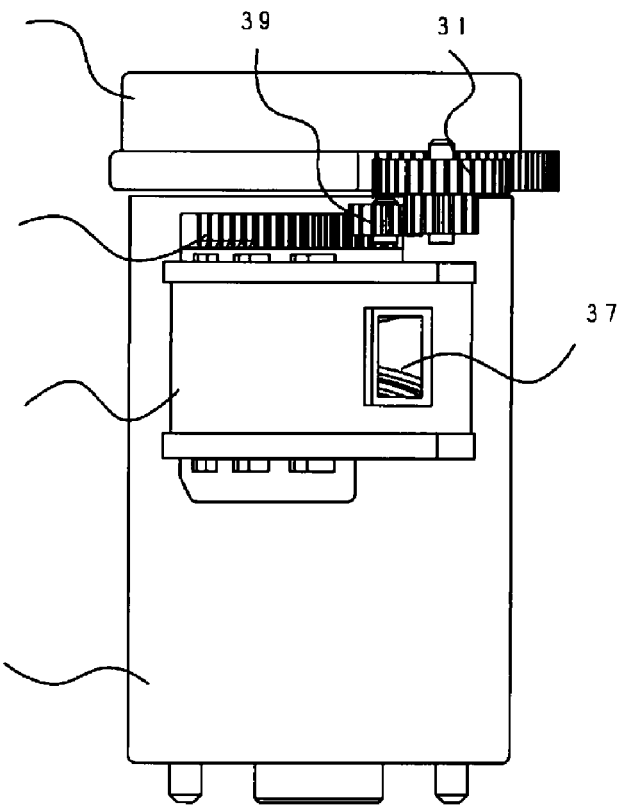

The toner supply portion 13 includes a shutter opening/closing gear 31 which is engaged with the handle 24 of the toner cartridge 2, and an idler gear 39 which is in engagement with the shutter opening/closing gear 31 and which is engaged with the cartridge shutter 27 of the toner cartridge 2 (see FIG. 7). With this, the buffer shutter 26 provided on the support stage 30 can be opened and closed by the opening and closing motion of the later-described shutter.

Here, the opening and closing motion of the toner cartridge 2 and the toner supply portion 13 will be described using FIG. 7.

The toner cartridge 2 is slid and inserted into the toner supply portion 13 in the direction of the arrow α (see FIG. 5). If the toner cartridge 2 is inserted to a predetermined position, the handle 24 is engaged with the shutter opening/closing gear 31, and the cartridge shutter 27 is engaged with a groove (not shown) formed in the buffer shutter 26.

Next, if a user rotates the handle 24 in the direction of the arrow β which is a shutter-opening direction by about 90°, the shutter opening/closing gear 31 rotates, the driving force is transmitted to an idler gear 39, and the cartridge shutter 27 is slid in the direction of the arrow γ.

At that time, since the buffer shutter 26 is in engagement with the cartridge shutter 27, the cartridge shutter 27 slides in the direction of the arrow γ together with the buffer shutter 26. With this, the cartridge discharge opening 37 provided in the toner container 25 is exposed. If the stirring blades 36 are rotated in this state, toner is conveyed from the toner container 25 to the toner supply portion 13.

Figure 8:
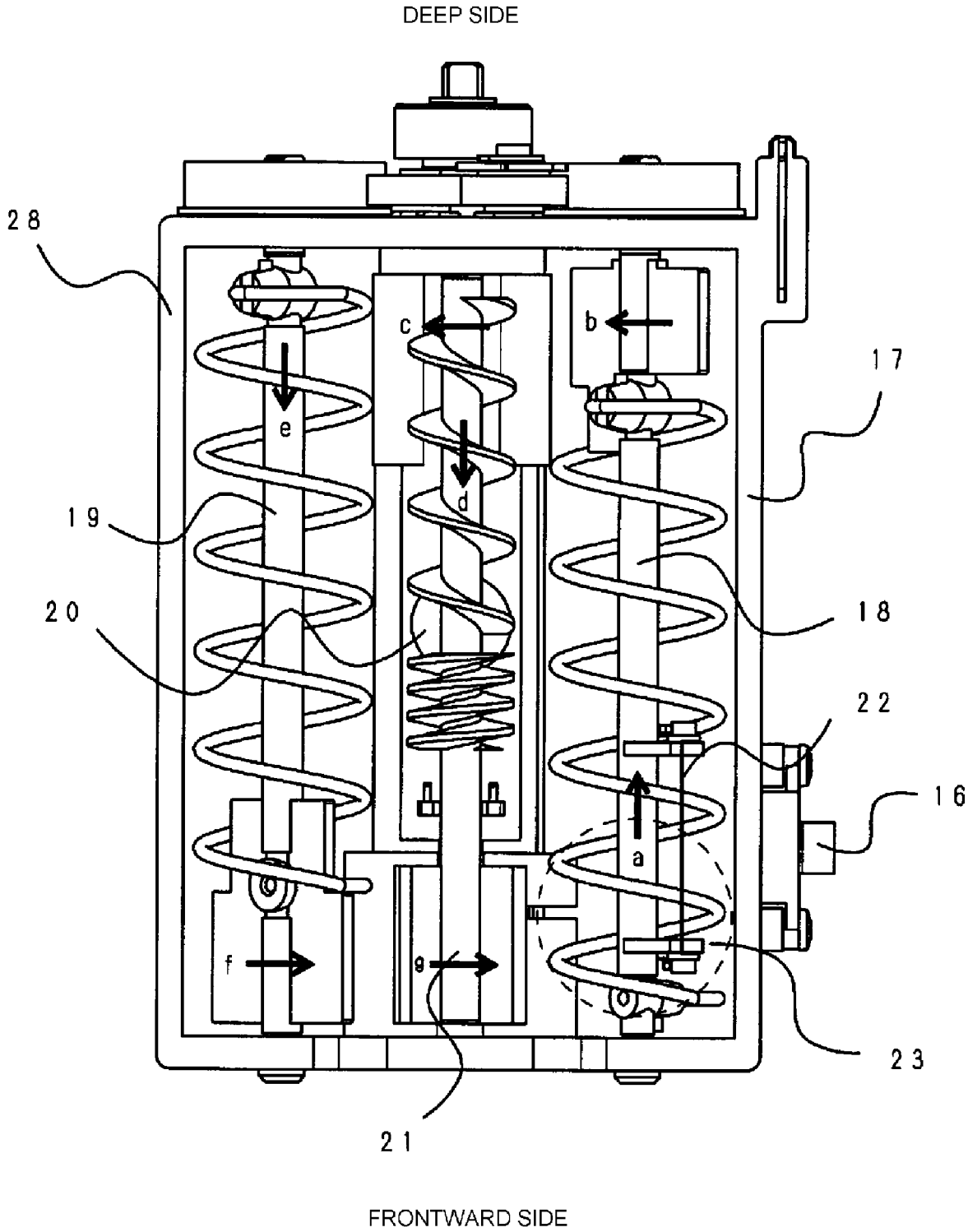
FIG. 8 is a top view of a buffer portion in the toner supply apparatus.

Next, a flow of toner in the buffer portion 28 will be described using FIG. 8. FIG. 8 is a sectional view of an upper surface of a toner supply portion showing a state in the buffer portion.

Toner discharged from the toner cartridge 2 is supplied to a toner supply position 23 of the buffer portion 28, and conveyed by the stirring screw 18 in the direction of the arrow a. If the toner is conveyed to the rearside of the buffer container 17, the toner is conveyed in the direction of the arrow b by a paddle provided on the rearside of the stirring screw 18.

The conveying screw 21 at the central portion in the buffer container 17. The conveying screw 21 conveys, in the direction of the arrow d, the toner which is conveyed by the stirring screw 18, and discharges the toner into the supply pipe 14 from the discharge opening 20 provided in substantially a central portion in the buffer container 17.

A surplus portion of the toner conveyed by the stirring screw 18 which was not conveyed by the conveying screw 21 is pushed out in the direction of the arrow c and conveyed toward the stirring screw 19.

The surplus portion of the toner conveyed to the stirring screw 19 is conveyed in the direction of the arrow e by the stirring screw 19. If the toner is conveyed to the frontward side of the buffer container 17, the toner is conveyed in the direction of the arrow f by the paddle provided on the frontward side of the stirring screw 19.

A paddle is provided also on the frontward side of the conveying screw 21, a surplus portion of the toner is conveyed in the direction of the arrow g by the paddle and the toner returns to the toner supply position 23 again.

This series of operation is repeated, toner is circulated and conveyed in the buffer portion 28, and a predetermined amount of toner is discharged into the supply pipe 14.

Figure 9:
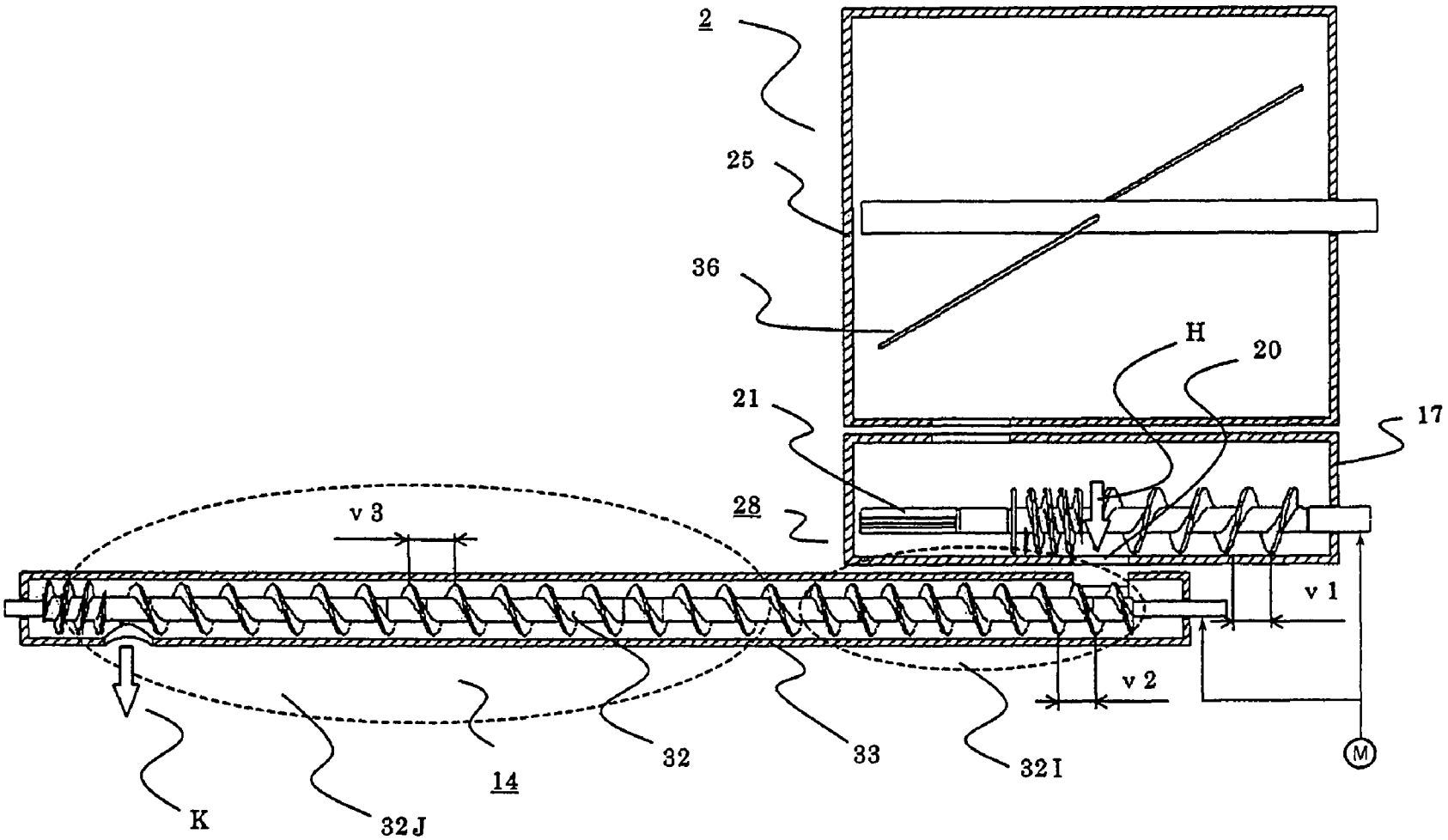
FIG. 9 is a diagram illustrating a relation between toner conveying amounts in the toner supply apparatus.

Next, a relation between the conveying screw 21 in the buffer portion 28 and the feeding amount of toner of the supply screw 32 of the supply pipe 14 will be described using FIG. 9.

As described above, the buffer portion 28 is provided with the conveying screw (first toner conveying unit) 21 for conveying a predetermined amount of toner to the supply pipe 14. The conveying screw 21 is spirally provided in the conveying direction of the toner. A feeding amount of toner of the conveying screw 21 is defined as V1.

The supply pipe 14 is provided with a supply screw (second toner conveying unit) 32 for conveying a predetermined amount of toner to the developing apparatus 5 through the toner supply portion 15. The supply screw 32 is spirally provided in the conveying direction of toner. The supply screw 32 includes an upstream side screw portion 32I provided upstream in the toner conveying direction (on the side of the buffer portion 28), and a downstream side screw portion 32J provided downstream of the toner conveying direction (on the side of the supply openings 12*a* to 12*d*). A screw pitch of the downstream side screw portion 32J of the supply screw 32 is wider than a screw pitch of the upstream side screw portion 32I. The feeding amount of toner of the upstream side screw portion 32I is defined as V2, and the feeding amount of toner of the downstream side screw portion 32J is defined as V3.

A reference symbol M represents a drive motor as drive unit. The conveying screw 21 and the supply screw 32 are rotated by this drive motor M.

When the two screws 21 and 32 are rotated by the drive motor M, a relation of the feeding amounts of toner per unit drive time becomes V2≦V1<V3. The toner feeding amounts V1, V2 and V3 are amounts of toner which is actually conveyed per unit drive time when the screws are driven. When the toner feeding amount per one rotation of the supply screw is defined as a minimum feeding amount, the above-described relation can be indicated by calculating the amount of toner satisfied between the screw pitches geometrically and multiplies a screw rotation ratio. This will be described more concretely.

Figure 10:
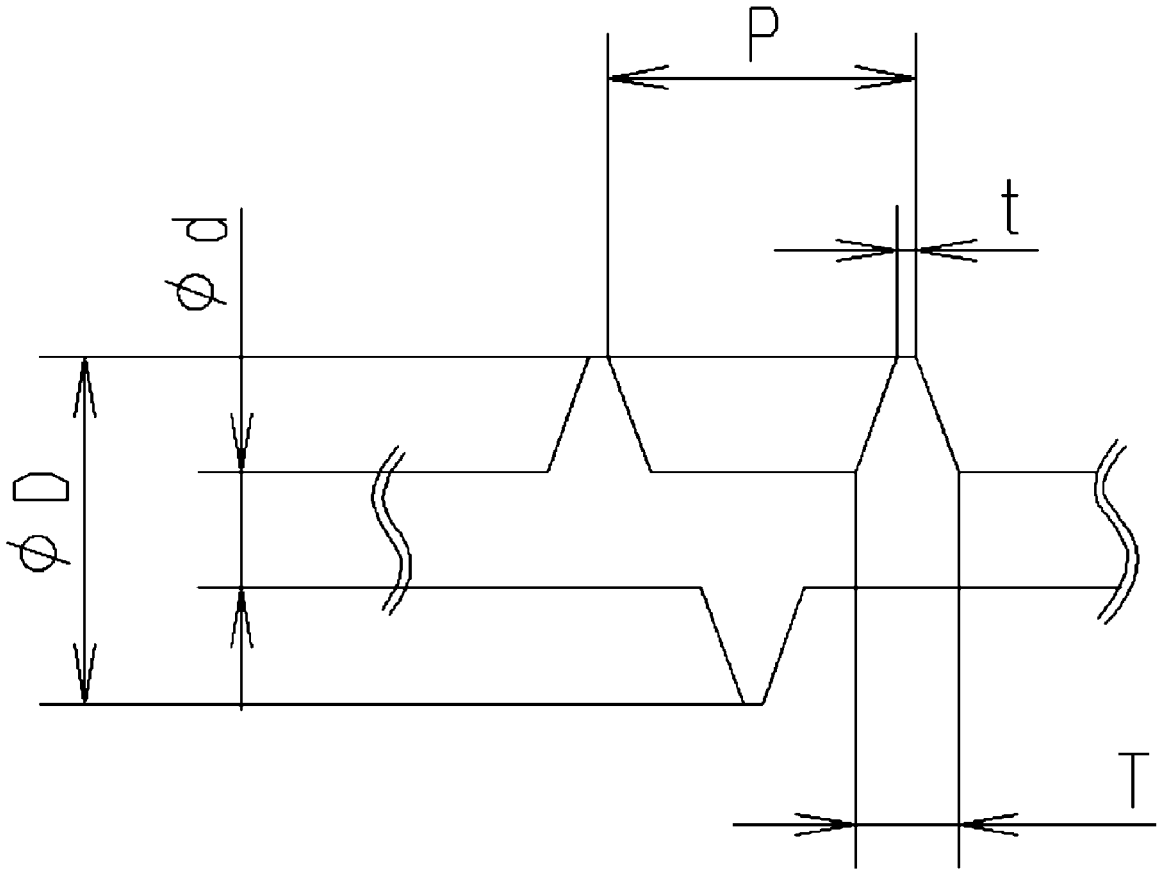
FIG. 10 is a diagram for describing a toner feeding amount in the toner supply apparatus.
Figure 11:
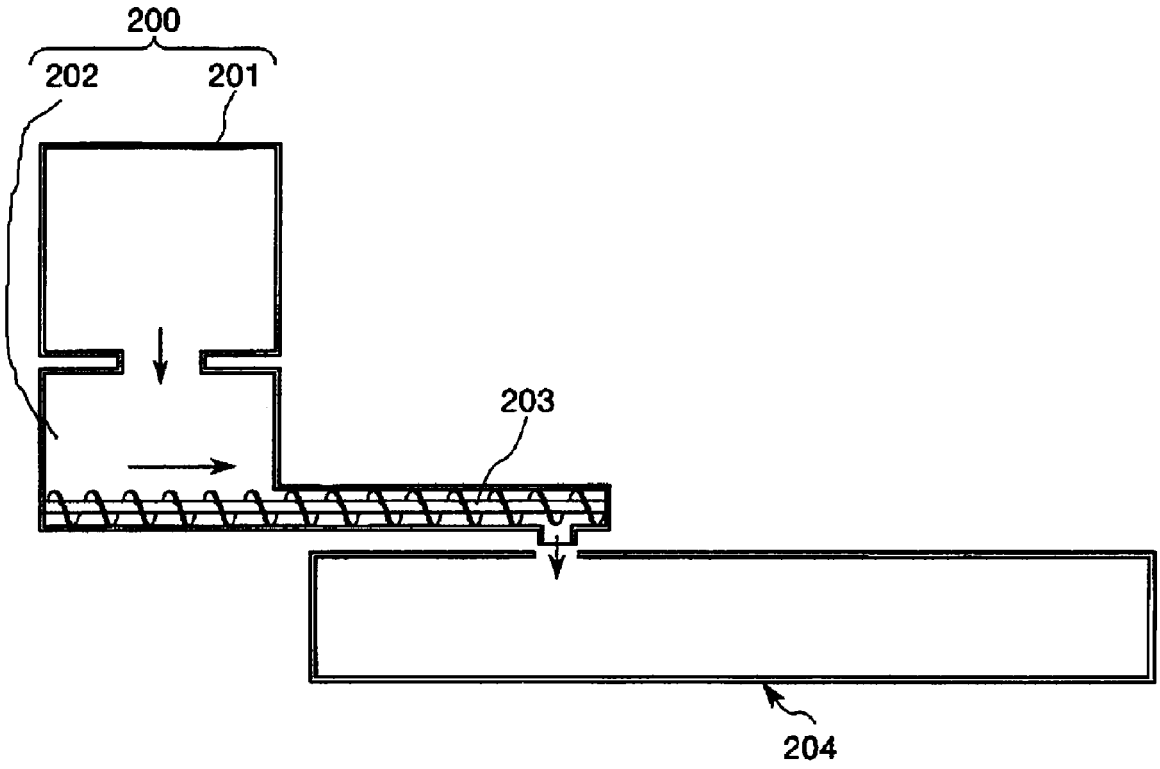
FIG. 11 is a diagram describing a conventional toner supply apparatus.
Figure 12:
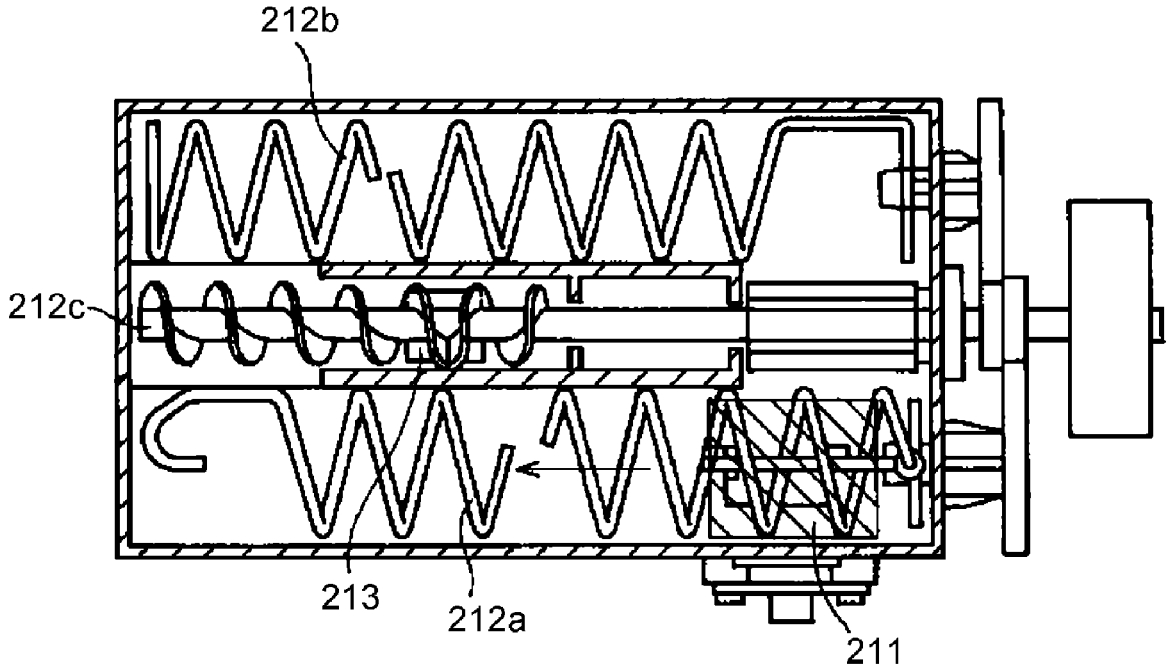
FIG. 12 is a diagram illustrating a buffer portion in the conventional toner supply apparatus.

In this embodiment, the screw portion is filled with toner and conveyed. The toner feeding amount per one screw pitch can be defined by multiplying a volume of one pitch of the screw by the bulk density of the toner. By defining the volume between the one pitch of the screw, it is possible to known the feeding amount. More concretely, as shown in FIG. 10, the volume of one pitch of the screw can be calculated by the relation of the following equation 1 under the condition that an inner diameter of the screw is defined as d, an outer shape of the screw is defined as D, a pitch of the screw is defined as P, a tip end width of the blade is defined as t, and a root width of the blade is defined as T:

$$\pi\left\{\left(\frac{D}{2}\right)^2-\left(\frac{d}{2}\right)^2\right\}\times\left(P-\frac{T+t}{2}\right) \quad \text{[Equation 1]}$$

In this case, as described above, the conveying screw 21 and the supply screw 32 are rotated by the same drive motor M, and the revolution numbers of the supply screw 32 is detected by the flag 34 and the photo-interrupter 35. The number of revolutions of the conveying screw 21 when the supply screw 32 rotates by one turn is defined as n (e.g., about ½). A feeding amount of toner by the conveying screw 21 when the supply screw 32 rotates by one turn, i.e., a toner feeding amount H from the buffer portion 28 to the supply pipe 14 is v1×n wherein the toner feeding amount per one pitch of the conveying screw 21 is defined as v1.

The relation between the toner feeding amounts of the upstream side screw portion 32I of the supply screw 32 is set in a range of v2≦v1×n wherein a toner feeding amount per one pitch of the upstream side screw portion 32I is defined as v2. With this, it is possible to fill the upstream side screw portion 32I of the supply screw 32 with toner, and to always convey a constant amount of toner. The toner feeding amount H of the conveying screw 21 is set greater than that of the upstream side screw portion 32I by about 5%.

An amount of toner v2 crammed into one pitch of the upstream side screw portion 32I is set equal to a minimum supply amount K of toner to be discharged from the supply pipe 14 to the supply opening 12. By rotating the supply screw 32, an amount of toner required by the developing apparatus 5 is supplied. The toner is crammed into the upstream side of the supply screw 32 from the conveying screw 21 and the toner is conveyed, an amount of toner to be fed to the developing apparatus is limited, and toner is conveyed precisely without varying the conveying amount.

A toner feeding amount v3 per one pitch of the downstream side screw portion 32J is set to a pitch capable of conveying toner greater than the feeding amount H which is the maximum amount of toner sent from the upstream side (v2<v3).

If the length of the supply screw 32 in the toner conveying direction becomes long, sliding resistance of toner accumulated around the pipe portion 33 and conveyed toner becomes great. Therefore, the rotation torque of the supply screw 32 is increased and the pressure applied to toner is increased. With this, the toner concentration degree is increased, toner easily adheres to the blade of the screw, and toner is not conveyed and rotates together with the blade. If toner is crammed into the pipe portion 33 without gap at that time, refuge of toner is eliminated, a pressure is locally increased, the toner concentration degree is further increased and toner easily adheres to the blade. As a result, rotation torque of the supply screw becomes heavy and rotation is locked, a clump of toner is created and this may cause image defect.

To prevent this, a screw pitch of the downstream side screw portion 32J of the supply screw 32 is wider than a screw pitch of the upstream side screw portion 32I. The relation of the toner feeding amount per one rotation of the supply screw 32 is set such that v2≦v1×n<v3. With this, toner can be supplied stably, the pressure during conveyance of toner can be reduced, and the concentration degree of toner can be prevented from increasing. Therefore, it is possible to avoid a case in which rotation of the supply screw is locked and operation failure is caused, and the concentration degree of toner is increased and image failure occurs.

Here, the downstream side screw portion 32J is provided on a supply screw 32 in which the number of pitches of the upstream side screw portion 32I is 8 or more.

The toner feeding amount v3 per one pitch of the downstream side screw portion 32J is set greater than the toner feeding amount v2 per one pitch of the upstream side screw portion 32I by about 20%. At that time, the downstream side screw portion 32J only conveys toner conveyed by the upstream side screw portion 32I to the supply opening 12 horizontally. Therefore, it is unnecessary to cram toner without creating a gap unlike the upstream side screw portion 32I. More concretely, if toner is filled up to the height equal to or higher than at least the rotation center of the supply screw 32, preferably up to such a height that the blade of the supply screw 32 is covered, it is possible to prevent variation in toner during conveyance.

Here, the relation of the toner feeding amount per one rotation of the supply screw 32 is set such that v2≦v1×n<v3, but the invention is not limited to this. As described above, other structure may be employed only if the relation of the toner feeding amount of the conveying screw 21 and the supply screw 32 satisfies V2≦V1<V3.

In the above-described embodiment, four toner supply apparatuses are used for forming a multi-color image, but the number of the toner supply apparatuses is not limited to four, and the number may be appropriately set in accordance with requirement.

In the above-described embodiment, a copying machine is used as an example of the image forming apparatus, but the invention is not limited to this. The invention can be applied to other image forming apparatuses such as a printer, a facsimile machine, and a multifunction machine. In the image forming apparatus, the intermediate transfer body is used, toner images of various colors are sequentially superposed on the intermediate transfer body, and toner images carried by the intermediate transfer body are collectively transferred onto the transfer material, but the invention is not limited to this. For example, the invention can be applied to such an image forming apparatus that a transfer material bearing member is used, toner images of various colors are sequentially superposed on the transfer material carried by the transfer material bearing member, thereby transferring the toner image. If the invention is applied to these toner supply apparatuses of the image forming apparatuses, the same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-040159, filed Feb. 21, 2007, which is hereby incorporated by reference herein in its entirety.

What is claimed is:

1. A toner supplying apparatus which conveys toner from a toner cartridge toward a developing apparatus, the toner supplying apparatus comprising:

a toner accommodating portion which accommodates toner therein supplied from the toner cartridge;

a toner conveying portion for conveying toner, which is received from the toner accommodating portion, toward the developing apparatus;

a first toner conveying member provided in the toner accommodating portion and which conveys toner to the toner conveying portion;

a second toner conveying member provided in the toner conveying portion and which conveys toner to the developing apparatus; and a drive device which drives the first toner conveying member and the second toner conveying member, wherein a toner feeding amount per unit drive time of the first toner conveying member is defined as V1, a toner feeding amount per unit drive time in an upstream region in the toner conveying direction of the second toner conveying member is defined as V2, and a toner feeding amount per unit drive time in a downstream region in the toner conveying direction of the second toner conveying member is defined as V3, and wherein the following relation is satisfied: $V2<V1$ and $V2<V3$.

2. The toner supplying apparatus according to claim 1, wherein the following relation is satisfied: $V2<V1<V3$.

3. The toner supplying apparatus according to claim 1, wherein the second toner conveying member is a conveying screw and a screw pitch thereof in the downstream portion is wider than a screw pitch thereof in the upstream portion.

4. A toner supplying apparatus which conveys toner from a toner cartridge toward a developing apparatus, the toner supplying container comprising:

a toner accommodating portion which accommodates toner therein supplied from the toner cartridge;

a toner conveying portion for conveying toner, which is received from the toner accommodating portion, toward the developing apparatus;

a first toner conveying member provided in the toner accommodating portion and which conveys toner to the toner conveying portion;

a second toner conveying member provided in the toner conveying portion and which conveys toner to the developing apparatus; and a drive device which drives the first toner conveying member and the second toner conveying member, wherein a number of revolutions of the first toner conveying member when the second toner conveying member is rotated by one turn by the drive device is defined as n, a toner feeding amount per pitch of the first toner conveying member is defined as V1, a toner feeding amount per pitch at an upstream region in the toner conveying direction of the second toner conveying member is defined as V2, and a toner feeding amount per pitch at a downstream region in the toner conveying direction of the second toner conveying member is defined as V3, and wherein the following relation is satisfied: $V2<V1\times n$, $V2<V3$.

5. The toner supplying apparatus according to claim 4, wherein the following relation is satisfied: $V2<V1\times n<V3$.

6. The toner supplying apparatus according to claim 4, wherein the second toner conveying member is a conveying screw and a screw pitch thereof in the downstream portion is wider than a screw pitch thereof in the upstream portion.

7. An image forming apparatus having developing apparatus which develops electro-statistic images formed on an image bearing member with toner, comprising the toner supplying apparatus according to any one of claims 1 through 6.

* * * * *